US006965748B2

(12) United States Patent
Embry et al.

(10) Patent No.: US 6,965,748 B2
(45) Date of Patent: Nov. 15, 2005

(54) DRIVE ROLLER FOR BELT IN AN ELECTROPHOTOGRAPHIC IMAGE FORMING APPARATUS

(75) Inventors: Kerry Leland Embry, Midway, KY (US); Richard Seman, Delmont, PA (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 62 days.

(21) Appl. No.: 10/811,188

(22) Filed: Mar. 26, 2004

(65) Prior Publication Data

US 2005/0214036 A1 Sep. 29, 2005

(51) Int. Cl.[7] ..... G03G 15/00
(52) U.S. Cl. ..... 399/302; 399/167
(58) Field of Search ..... 399/162, 167, 399/302–303, 308, 312–313, 388, 400; 158/832, 158/834, 835; 474/137, 187

(56) References Cited

U.S. PATENT DOCUMENTS 2,056,273 A * 10/1936 Holdsworth ..... 427/188
5,089,363 A * 2/1992 Rimai et al. ..... 430/45
5,186,981 A * 2/1993 Shellhamer et al. ..... 427/247
5,294,102 A * 3/1994 Ifkovits et al. ..... 271/35
5,347,347 A * 9/1994 Hilbert et al. ..... 399/223
5,418,105 A * 5/1995 Wayman et al. ..... 430/126
5,691,039 A * 11/1997 Rimai et al. ..... 428/195.1
5,895,154 A * 4/1999 Acquaviva et al. ..... 399/341
6,187,129 B1 * 2/2001 Vaidya et al. ..... 156/275.5
2001/0055040 A1 * 12/2001 Nojima ..... 347/16
2002/0057321 A1 * 5/2002 Rasmussen et al. ..... 347/101
2003/0099007 A1 * 5/2003 Towner et al. ..... 358/520

* cited by examiner

*Primary Examiner*—Gail Verbitsky
(74) *Attorney, Agent, or Firm*—Coats & Bennett, PLLC

(57) ABSTRACT

An electrophotographic image forming apparatus comprises a drive roller having a textured finish with a plurality of microscopic protrusions and a plurality of microscopic depressions; the drive roller comprising a shaft and a surface coating on the shaft; a flexible belt having a first hardness driven by the drive roller, the belt moving at least one of a toner image or a recording media having a toner image thereon; with the surface coating comprising a base compound and plurality of grit particles having a second hardness which is higher than the first hardness. The grit coating may advantageously have a thickness of not more than about 50 microns. The grit particles may comprise one or more ceramics, or one or more polymer compounds, or other materials. The drive roller advantageously has a coefficient of static friction of at least 0.5 with the belt.

25 Claims, 4 Drawing Sheets

DRIVE ROLLER FOR BELT IN AN ELECTROPHOTOGRAPHIC IMAGE FORMING APPARATUS

FIELD OF THE INVENTION

The present invention is directed generally the field of electrophotographic image formation, and more particularly to a belt driving system in an electrophotographic image forming apparatus, such as a laser printer, that uses a belt drive roller with a surface coating.

BACKGROUND OF THE INVENTION

Many electrophotographic printing process rely on belts to move either the print media or a toner image. Such belts should be driven in a reliable fashion, with a minimum of slippage. When very smooth drive rollers are used, dirt, used toner, and other debris may enter between the drive surface of the belt and the drive roller over time, leading to undesirable slippage. While a number of drive roller configurations have been proposed in the prior art, there remains a need for alternative designs.

SUMMARY OF THE INVENTION

The present invention, in one embodiment, provides an electrophotographic image forming apparatus comprising a drive roller, the drive roller comprising a shaft and a surface coating on the shaft; an exterior surface of the drive roller having a textured finish with a plurality of microscopic protrusions and a plurality of microscopic depressions; a flexible belt having a first hardness driven by the drive roller, the belt moving at least one of a toner image or a recording media having a toner image thereon in a electrophotographic image forming apparatus; and wherein the surface coating comprises a base compound and plurality of grit particles; the grit particles corresponding to the protrusions and having a second hardness which is higher than the first hardness. The grit coating may advantageously have a thickness of not more than about 50 microns, such as a thickness in the range of about 30 microns to about 50 microns. The grit particles may comprise one or more ceramics, or one or more polymer compounds, or other materials. The drive roller advantageously has a coefficient of static friction of at least 0.5 with the surface of the belt that it engages. The shaft may have a machined surface, with the surface coating applied to the machined surface. The shaft may comprise an aluminum shaft, optionally with at least one longitudinal passage, and further optionally, with a plurality of interior ribs and a plurality of longitudinal passages disposed between the plurality of interior ribs.

In another embodiment, a method of forming a electrophotographic image forming apparatus comprises providing a shaft having a surface; applying a coating to the surface to form a drive roller with a coated exterior surface having a textured finish with a plurality of microscopic protrusions and a plurality of microscopic depressions; the surface coating comprising a base compound and plurality of grit particles having a first hardness; the grit particles corresponding to the protrusions; and disposing the drive roller to drive a flexible belt, the flexible belt having a second hardness which is lower than the first hardness; the belt operative to move at least one of a toner image or a recording media having a toner image thereon in the electrophotographic image forming apparatus. The coating on the surface of the shaft may have a thickness of not more than about 50 microns, such as a thickness in the range of about 30 microns to about 50 microns. The grit particles may comprise one or more ceramics, or one or more polymer compounds, or other materials. The disposing of the drive roller to drive a flexible belt may comprise disposing the drive roller to drive the flexible belt with a coefficient of static friction of at least 0.5 therebetween. The shaft may have a machined surface, and applying a coating to the surface to form a drive roller may comprise applying the coating to the machined surface to form a drive roller. The shaft may be an aluminum shaft, optionally with at least one longitudinal passage, and further optionally with at least one longitudinal passage comprises providing the aluminum shaft with a plurality of interior ribs and a plurality of longitudinal passages disposed between the plurality of interior ribs.

DETAILED DESCRIPTION OF THE INVENTION

As the present invention relates to a drive roller for belt drive system in an electrophotographic image forming apparatus, an understanding of the basic elements of an electrophotographic image forming apparatus may aid in understanding the present invention. For purposes of illustration, two different four cartridge color laser printers will be described; however one skilled in the art will understand that the present invention is applicable to other types of electrophotographic image forming apparatuses that use one or more toner colors for printing. Further, for simplicity, the discussion below may use the terms "sheet" and/or "paper" to refer to the recording media 5; this term is not limited to paper sheets, and any form of recording media is intended to be encompassed therein, including without limitation, envelopes, transparencies, plastic sheets, postcards, and the like.

Figure 1:
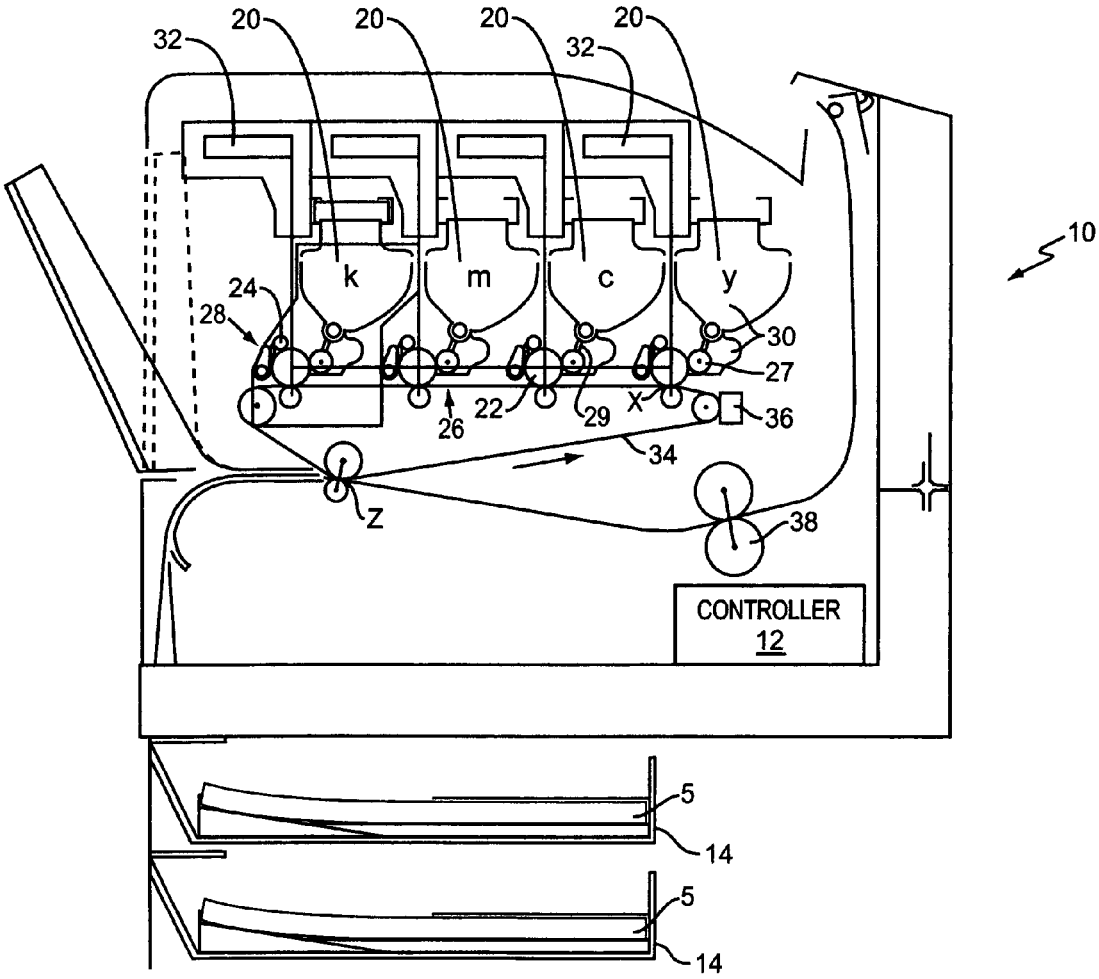
FIG. 1 shows one embodiment of an image forming apparatus using a intermediate transfer belt.

One embodiment of a four color laser printer is shown in FIG. 1 and generally designated 10. The printer 10 typically includes a plurality of optionally removable toner cartridges 20 that have different toner color contained therein, an intermediate transfer medium 34, a fuser 38, and one or more recording media supply trays 14. For instance, the printer 10 may include a black (k) cartridge 20, a magenta (m) cartridge 20, a cyan (c) cartridge 20, and a yellow (y) cartridge 20. Typically, each different color toner forms an individual image of a single color that is combined in a layered fashion to create the final multi-colored image, as is well understood in the art. Each of the toner cartridges 20 may be substantially identical; for simplicity only the operation of the cartridge 20 for forming yellow images will be described, it being understood that the other cartridges 20 may work in a similar fashion.

The toner cartridge 20 typically includes a photoconductor 22 (or "photo-conductive drum" or simply "PC drum"), a charger 24, a developer section 26, a cleaning assembly 28, and a toner supply bin 30. In one embodiment, the photoconductor 22 is generally cylindrically-shaped with a smooth surface; this photoconductor may comprise an aluminum hollow-core drum coated with one or more layers of light-sensitive organic photoconductive materials. The surface of photoconductor 22 receives an electrostatic charge as the photoconductor 22 rotates past charger 24. The photoconductor 22 rotates past a scanning laser 32 directed onto a selective portion of the photoconductor surface forming an electrostatically latent image representative of the image to be printed. Drive gears (not shown) may rotate the photoconductor 22 continuously so as to advance the photoconductor 22 some uniform amount, such as 1/120th or 1/1200th of an inch, between laser scans. This process continues as the entire image pattern is formed on the surface of the photoconductor 22.

After receiving the latent image, the photoconductor 22 rotates to the developer section 26 which has a toner bin 30 for housing the toner and a developer roller 27 for uniformly transferring toner to the photoconductor 22. The toner is typically transferred from the toner bin 30 to the photoconductor 22 through a doctor blade nip formed between the developer roller 27 and the doctor blade 29. The toner is typically a fine powder constructed of plastic granules that are attracted and cling to the areas of the photoconductor 22 that have been discharged by the scanning laser 32. To prevent toner escape around the ends of the developer roller 27, end seals may be employed, such as those described in U.S. Pat. No. 6,487,383, entitled "Dynamic End-Seal for Toner Development Unit," which is incorporated herein by reference.

The photoconductor 22 next rotates past an adjacently-positioned intermediate transfer medium ("ITM"), such as belt 34, to which the toner is transferred from the photoconductor 22. The location of this transfer from the photoconductor 22 to the ITM belt 34 is called the first transfer point (denoted X in FIG. 1). After depositing the toner on the ITM belt 34, the photoconductor 22 rotates through the cleaning section 28 where residual toner is removed from the surface of the photoconductor 22, such as via a cleaning blade well known in the art. The residual toner may be moved along the length of the photoconductor 22 to a waste toner reservoir (not shown) where it is stored until the cartridge 20 is removed from the printer 10 for disposal. The photoconductor 22 may further pass through a discharge area (not shown) having a lamp or other light source for exposing the entire photoconductor surface to light to remove any residual charge and image pattern formed by the laser 32.

As illustrated in FIG. 1, the ITM belt 34 is endless and extends around a series of rollers adjacent to the photoconductors 22 of the various cartridges 20. The ITM belt 34 and each photoconductor 22 are synchronized by controller 12, via gears and the like well known in the art, so as to allow the toner from each cartridge 20 to precisely align on the ITM belt 34 during a single pass. By way of example as viewed in FIG. 1, the yellow toner will be placed on the ITM belt 34, followed by cyan, magenta, and black. The purpose of the ITM belt 34 is to gather the image from the cartridges 20 and transport it to the sheet 5 to be printed on.

The paper 5 may be stored in paper supply tray 14 and supplied, via a suitable series of rollers, belts, and the like, to the location where the sheet 5 contacts the ITM belt 34. At this location, called the second transfer point (denoted Z in FIG. 1), the toner image on the ITM belt 34 is transferred to the sheet 5. If desired, the sheet 5 may receive an electrostatic charge prior to contact with the ITM belt 34 to assist in attracting the toner from the ITM belt 34. The sheet 5 and attached toner next travel through a fuser 38, typically a pair of rollers with an associated heating element, that heats and fuses the toner to the sheet 5. The paper 5 with the fused image is then transported out of the printer 10 for receipt by a user. Alternatively, the paper 5 may be routed to a duplex paper path for printing on another side of paper 5, in any fashion known in the art. After rotating past the second transfer point Z, the ITM belt 34 is cleaned of residual toner by an ITM cleaning assembly 36 so that the ITM belt 34 is clean again when it next approaches the first transfer point X.

One commercial example of a printer 10 operating generally as described above, including an ITM belt, but not including the present invention, is the Model C750 currently available from Lexmark International, Inc. of Lexmark, Ky.

Figure 2:
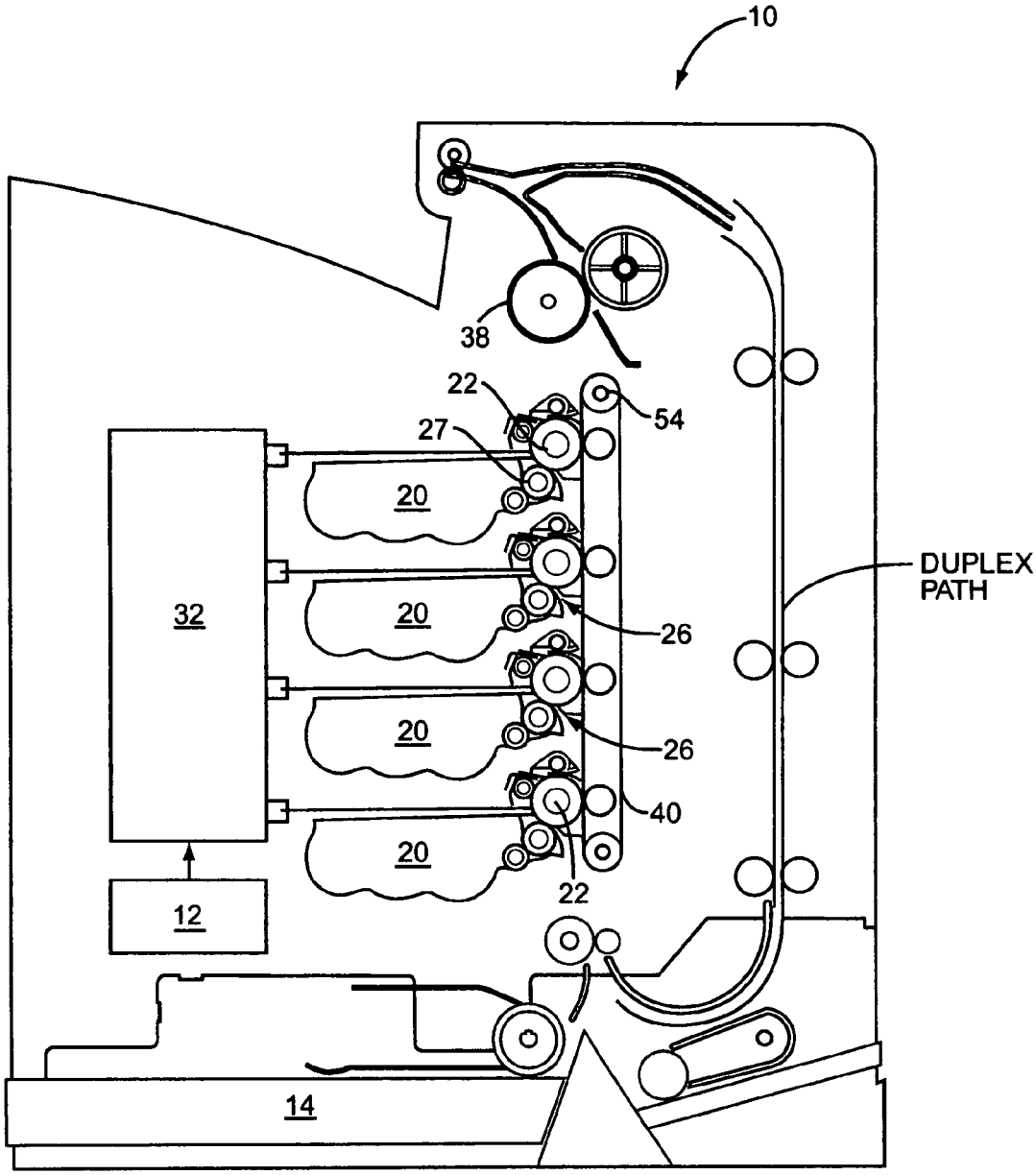
FIG. 2 shows another embodiment of an image forming apparatus using a media transport belt.

In alternative embodiments, the printer 10 may not include an ITM belt 34, but may instead use a "direct transfer" approach. For such printers, an example of which is shown in FIG. 2, the photoconductors 22 of the various cartridges 22 transfer the developed image directly to the paper 5 as the paper 5 is carried past the cartridges 20 on a media transport belt 40. The media transport belt 40 then carries the paper 5, with the image thereon, toward the fuser 38.

The present invention relates to a belt driving system 50 for an electro-photographic image forming apparatus. Because the relevant belt of the belt driving system 50 may be either the ITM belt 34 or the media transfer belt 40, the belt will be generically referred to as the belt 52. The belt 52 is typically made from a plastic-like material, such as a thermoplastic elastomer, polycarbonate, nylon, or any other material known in the art. The belt 52 may be coated, particularly on its exterior side, with appropriate compounds to adjust or otherwise control the properties of the belt's surface, particularly the belt's outer surface. Further, the belt 52 may have suitable ribs, holes, reflectors, or the like to aid in registration, tracking, and/or alignment. Such belts 52 are typically driven by a drive roller 54 of a belt driving system 50 so as to move in a circular, or closed-loop, fashion in either both directions (i.e., clockwise and counter-clockwise) or in only one direction. The movement of the belt 52 may be continuous or may be intermittent, as is desired. As is understood by those of skill in the art, the belt 52 should have a width that is large enough to accommodate the widest image to be printed, with additional space on each lateral edge. The thickness of the belt 52 will depend on the application, but is typically smaller than the width of the belt 52 by at least two orders of magnitude, and more typically by about three orders of magnitude or more.

Figure 3:
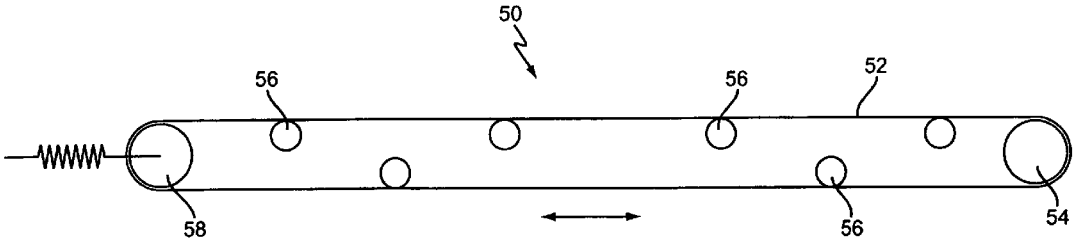
FIG. 3 shows a side view of a belt drive system useable in the image forming apparatus of FIG. 1 or FIG. 2.

In the belt driving system 50, the belt 52 is typically routed around at least one drive roller 54, one or more idler rollers 56, and optionally a tension roller 58. For simplicity, the belt 52 of FIG. 3 is shown being routed around one drive roller 54, one tension roller 58, and six idler rollers 56, although any configuration with one or more drive rollers 54 may be used for the present invention. It should be noted that any of these rollers 54,56,58 may serve other functions as well, such as opposition rollers at various transfer points, but these other functions are not important for understanding the present invention.

Figure 4:
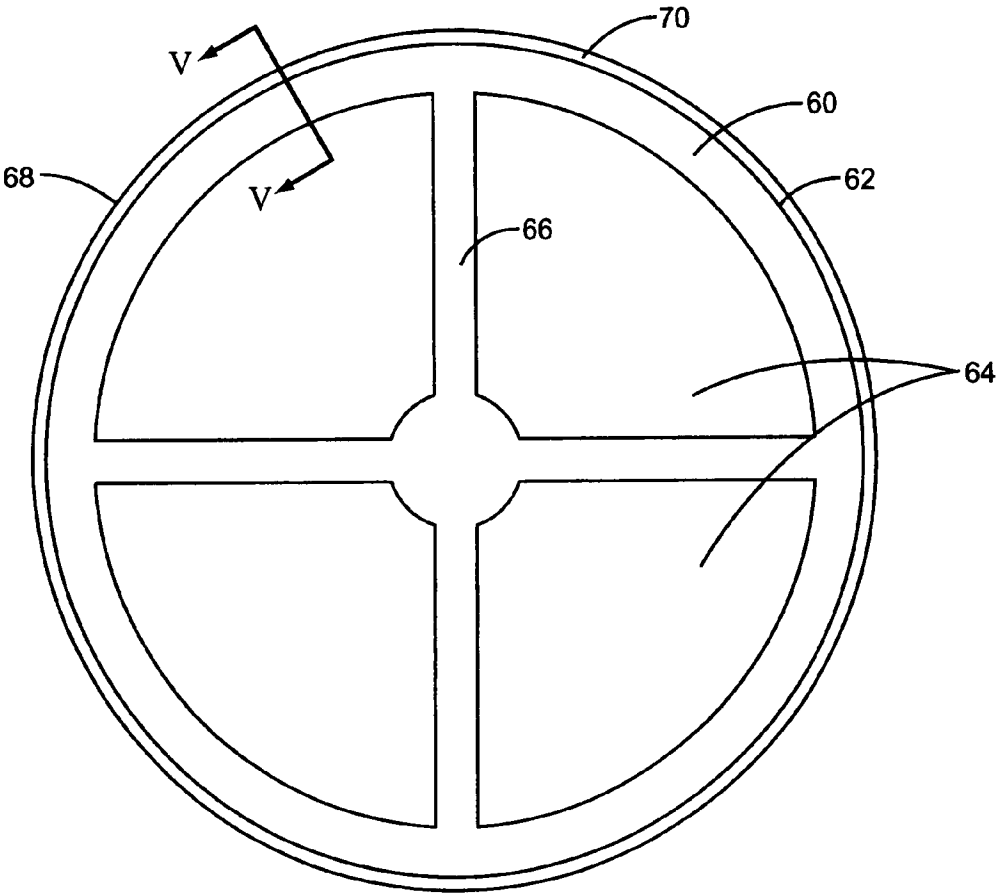
FIG. 4 shows an end view of one embodiment of a drive roller according to the present invention.

The drive roller 54 shown in FIG. 4 includes a shaft 60 with a surface coating 70 thereon. The shaft 60 is a generally elongate cylindrical body with a machined surface 62 with excellent concentricity and runout about the longitudinal rotation axis of the shaft 60. For example, the concentricity should advantageously be ±0.05 mm, with a parallelism tolerance of ±0.05 mm and runout of ±0.05 mm, or better.

The shaft 60 may be made from various materials, such as aluminum, steel, or plastic. In addition, the shaft 60 may be solid or may be relatively hollow. For example, the shaft 60 may include a plurality of ribs 66 running from the center axial region of the shaft 60 out to the circumferential ring that forms the peripheral surface. These ribs 66 may advantageously be disposed radially, but this is not required. A plurality of internal longitudinal passages 64 may be disposed between the ribs 66. The ends of the shaft 60 may be machined or otherwise configured to accept short stub shafts (not shown), such as short steel pins, for rotatably supporting the shaft 60 within the image forming device 10.

The external surface 62 of the shaft 60 has a coating 70 thereon that forms a textured surface 68 with a plurality of small protrusions 82 and depressions 84. This coating 70 may advantageously comprise a base material 72 with a plurality of so-called grit particles 74. These grit particles 74 are relatively hard, and their presence causes the formation of the protrusions 82, with the intervening areas forming the depressions 84. The grit particles 74 may be a variety of materials, such as ceramics, aluminum oxide, polymers (e.g., rubber, ethylene-propylene-diene terpolymer (EPDM), urethane), and the like. It is intended that the grit particles 74 will have a hardness that is higher than the hardness of the belt 52, so that the grit particles 74 of the coating 70 will be able to slightly (and elastically) deform the inner surface of the belt 52 so as to increase the static friction therebetween. Indeed, the effective coefficient of static friction between the drive roller 54 and the belt 52 should advantageously be 0.5 or more.

Figure 5:
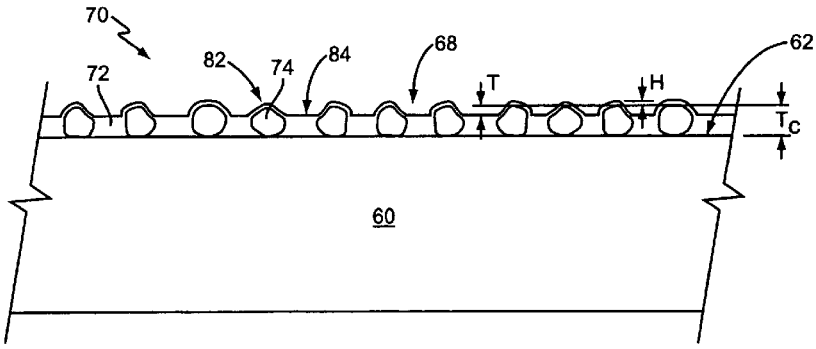
FIG. 5 shows a cross-section view of the surface of the driver roller of FIG. 4 along line V—V.

The protrusions 82 and the depressions 84 on the surface 68 of the drive roller 54 are should not be large, but should instead be microscopic. The term "microscopic," as applied to the protrusions 82 and the depressions 84 means that the height H of the protrusions 82 from the local mean thickness $T_c$ of the coating 70 is not more than 0.05 mm, and the depth D of the depressions 84 from the local mean thickness $T_c$ of the coating 70 is not more than 0.05 mm. See FIG. 5 where the thickness of the coating 70 and the size of the grit particles 74 are exaggerated for illustrative purposes. In addition, the coating 70 on the drive roller 54 should be relatively thin, with the mean thickness of the coating $T_c$ being on the order of about fifty microns or less, and preferably thirty to fifty microns. Making the coating 70 this thin allows the dimensional tolerances of the machined shaft 60 to heavily determine the dimensions of the resulting drive roller 54. Further, it should be noted that while the coating 70 is uniformly applied to the shaft 60, with the grit particles 74 uniformly distributed on a macro scale, the distribution of the grit particles 74 need not be in a regular matrix or other highly ordered arrangement.

The coating 70 may be applied to the shaft 60 by spraying a slurry of the base material 72 and the grit particles 74 onto the machined surface 62 of the shaft 60, advantageously using an automated process. For example, the shaft 60 may be mounted to a suitable fixture and placed in a sprayer chamber. A mixture of grit particles 74 suspended in a suitable solution of the base material 72 may then be sprayed onto the surface 62 of the shaft 60 while the shaft 60 is rotated. Of course, such a spray-based process is not strictly required, and other coating application approaches may be used.

The presence of the protrusions 82 and depressions 84 on the surface of the drive roller 54 may advantageously serve two different functions, at least in the preferred embodiments. First, the because the grit particles 74 are harder than the belt 52, the protrusions 82 on the drive roller 54 will extend slightly into the interior surface of belt 52, thereby increasing the mechanical locking between the drive roller 54 and the belt 52. Second, the depressions 84 between the protrusions 82 provide areas where debris, such as errant toner, may migrate without interfering with the belt drive function of the drive roller 54.

The discussion above has been in the context of a multicolor laser printer 10 for illustrative purposes; however, it should be noted that the present invention is not so limited and may be used in any electrophotographic system, including laser printers, copiers, and the like. Further, it should be noted that it may be advantageous, if multiple toner cartridges 20 are used in the printer 10, to have the effective drive diameter (diameter of roller with the coating on plus one-half the belt thickness) to be equal to an integer multiple of the spacing between the transfer points of adjacent toner cartridges 20.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. An electrophotographic image forming apparatus, comprising:

a drive roller comprising a shaft and a surface coating on said shaft; an exterior surface of said drive roller having a textured finish with a plurality of microscopic protrusions and a plurality of microscopic depressions;

a flexible belt having a first hardness driven by said drive roller, said belt moving at least one of a toner image or a recording media having a toner image thereon in a electrophotographic image forming apparatus; and wherein said surface coating comprises a base compound and plurality of grit particles; said grit particles corresponding to said protrusions and having a second hardness which is higher than said first hardness.

2. The apparatus of claim 1 wherein said surface coating has a thickness of not more than about 50 microns.

3. The apparatus of claim 2 wherein said surface coating has a thickness in the range of about 30 microns to about 50 microns.

4. The apparatus of claim 1 wherein said grit particles comprise one or more ceramics.

5. The apparatus of claim 1 wherein said grit particles comprise one or more polymer compounds.

6. The apparatus of claim 1 wherein said grit particles comprise aluminum oxide.

7. The apparatus of claim 1 wherein said drive roller has a coefficient of static friction of at least 0.5 with said belt.

8. The apparatus of claim 1 wherein said shaft comprises a shaft having a machined surface, said surface coating applied to said machined surface.

9. The apparatus of claim 1 wherein said shaft comprises an aluminum shaft.

10. The apparatus of claim 8 wherein said shaft includes at least one longitudinal passage.

11. The apparatus of claim 10 wherein said shaft comprises a plurality of interior ribs and a plurality of longitudinal passages disposed between said plurality of interior ribs.

12. The apparatus of claim 1 further comprising a plurality of toner cartridges supplying toner for said toner image.

13. The apparatus of claim 1:

wherein said shaft comprises a shaft having a machined surface, said surface coating applied to said machined surface;

wherein said surface coating has a thickness in the range of about 30 microns to about 50 microns; and wherein said drive roller has a coefficient of static friction of at least 0.5 with said belt.

14. The apparatus of claim 13 wherein said shaft comprises an aluminum shaft with a plurality of interior ribs and a plurality of longitudinal passages disposed between said plurality of interior ribs.

15. A method of forming a electrophotographic image forming apparatus, comprising:

providing a shaft having a surface;

applying a coating to said surface to form a drive roller with a coated exterior surface having a textured finish with a plurality of microscopic protrusions and a plurality of microscopic depressions; said surface coating comprising a base compound and plurality of grit particles having a first hardness; said grit particles corresponding to said protrusions; and disposing said drive roller to drive a flexible belt, said flexible belt having a second hardness which is lower than said first hardness; said belt operative to move at least one of a toner image or a recording media having a toner image thereon in the electrophotographic image forming apparatus.

16. The method of claim 15 wherein said coating on said surface of said shaft has a thickness of not more than about 50 microns.

17. The method of claim 16 wherein said coating on said surface of said shaft has a thickness in the range of about 30 microns to about 50 microns.

18. The method of claim 15 wherein said grit particles comprise one or more ceramics.

19. The method of claim 15 wherein said grit particles comprise one or more polymer compounds.

20. The method of claim 15 wherein disposing said drive roller to drive a flexible belt comprises disposing said drive roller to drive said flexible belt with a coefficient of static friction of at least 0.5 therebetween.

21. The method of claim 15 wherein providing a shaft comprises providing a shaft with a machined surface, and wherein applying a coating to said surface to form a drive roller comprises applying said coating to said machined surface to form a drive roller.

22. The method of claim 15 wherein providing a shaft comprises providing an aluminum shaft.

23. The method of claim 15 wherein providing a shaft comprises providing an aluminum shaft with at least one longitudinal passage.

24. The method of claim 23 wherein providing said shaft with at least one longitudinal passage comprises providing said shaft with a plurality of interior ribs and a plurality of longitudinal passages disposed between said plurality of interior ribs.

25. The method of claim 15:

wherein providing a shaft comprises providing a shaft having a machined surface;

wherein applying a coating to said surface to form a drive roller comprises applying said coating with a thickness in the range of about 30 microns to about 50 microns to said machined surface to form a drive roller; and wherein disposing said drive roller to drive a flexible belt comprises disposing said drive roller to drive said flexible belt with a coefficient of static friction of at least 0.5 therebetween.

* * * * *